United States Patent [19]

McCoy, Jr.

[11] 4,355,424

[45] Oct. 26, 1982

[54] X-RAY GLOVES AND LINER

[76] Inventor: William J. McCoy, Jr., 26 Quarry Rd., Stamford, Conn. 06903

[21] Appl. No.: 182,955

[22] Filed: Sep. 2, 1980

[51] Int. Cl.[3] ..... A41D 19/00

[52] U.S. Cl. ..... 2/161 R; 2/164; 2/167

[58] Field of Search ..... 2/159, 161 R, 162, 164, 2/167, DIG. 6

[56] References Cited

U.S. PATENT DOCUMENTS

| | | | |
|---|---|---|---|
| 1,689,212 | 10/1928 | Picker | 2/164 X |
| 1,748,833 | 2/1930 | Dunne | 2/159 |
| 2,591,905 | 4/1952 | Kennedy | 2/164 |
| 3,000,384 | 9/1961 | Piers | 2/DIG. 6 |
| 3,009,235 | 11/1961 | Mestral | 2/161 R |
| 3,916,448 | 11/1975 | Hamel | 2/164 X |
| 4,006,495 | 2/1977 | Jones | 2/DIG. 6 |
| 4,183,100 | 1/1980 | De Marco | 2/164 X |
| 4,214,321 | 7/1980 | Nuwayser | 2/161 R |

*Primary Examiner*—Louis Rimrodt

*Attorney, Agent, or Firm*—William G. Rhines

[57] ABSTRACT

Embodiments of this invention, particularly useful as X-ray protective gloves, include an outer X-ray proof glove, and an associated inner glove, wherein the latter has an outer surface of polyester foam and an inner surface of knitted polyester, and the inner surface of the outer glove and the outer surface of the inner glove have correspondingly positioned elements of a velcro fastener in the wrist region, whereby the inner glove may be rendered removable with minimal tendency to slip with respect to the outer glove while in use.

9 Claims, 3 Drawing Figures

X-RAY GLOVES AND LINER

BACKGROUND OF INVENTION

In the field of X-ray and its use as a diagnostic device, it is known to use protective gloves. Such gloves typically comprising a layer made from a lead-bearing material whereby the transmission of radiation to the hand and forearm of the operator may be inhibited to safe levels or even blocked altogether. Typically they have a liner, which usually is permanently affixed to the outer glove, since the radiation barrier material of the latter renders it smooth and of low friction, which, without such affixation, makes it highly susceptable to slipping loose from a removeable liner. Furthermore, such gloves are air and moisture tight, making it necessary to make the liners moisture absorbent, without provision having been made to dry the liner out after use of the gloves. A usual practice is for operators to wear separate cotton gloves in addition, so as to achieve the cleaning, drying and other features hereinafter described. However, the resulting combination is very bulky and does not satisfactorily bar the tendency of the outer glove to slip off, due to its comparatively great weight. In this connection reference is made to Picker U.S. Pat. No. 1,689,212. The innermost surface of the attached liner may be modified to increase its porosity, and consequent ability for air and moisture to pass through it, as by incorporating an inner chamois coating. This is comparatively expensive and, in any event, does not provide the liner removeability which is highly desired, to enable the hand-facing surface to be cleaned and to be replaced when worn out since it is usually made from less durable material than the glove itself. The use of glove liners per se is known, as is the practice of sueding the inner surface of a glove to inhibit the tendency of the glove to slip off of an associated liner. This, however, involves a process which inherently is derogatory to the glove body, and is expensive and difficult to perform. In this connection, reference is made to U.S. Pat. No. 2,591,905. Such alternatives which may be moderately effective with lightweight gloves, may not be effective for use with comparatively heavy outer gloves of the lead-filled type used in X-ray applications. The use has been disclosed of an intermediate layer of foamed polyurethane to increase the insulation value between the liner and the outer glove, but, for example, such use as disclosed in U.S. Pat. No. 3,114,915 involves permanently integrating the layer into the total glove construction and accompanying it by a slip-inducing layer so as to prevent "bunching".

Retention between a glove and a liner may be effected by the use of mechanical connectors, such as snaps. In this connection reference is made to U.S. Pat. Nos. 2,418,887 and 1,748,833. Such devices require exact alignments and are otherwise rigid to an extent which renders them impractical, particularly for use in things like X-ray exposure application, where radiation exposure precludes any part of the fastener from extending through the outer glove, because the glove material characteristically is so dense and smooth, is difficult to achieve affectively using adhesives.

Accordingly, it is an objective of the present invention to provide means for removeably retentatively positioning a glove liner inside a glove.

Another objective of this invention is to provide such means adapted for use with outer gloves of relatively dense, smooth and/or heavy material.

Still another objective is to provide means for achieving the foregoing objectives which is not positionally or alignment critical.

DESCRIPTION OF DRAWINGS

This invention may be understood from the description which follows and from the accompanying drawings in which.

DESCRIPTION OF PREFERRED EMBODIMENTS

Figure 1:
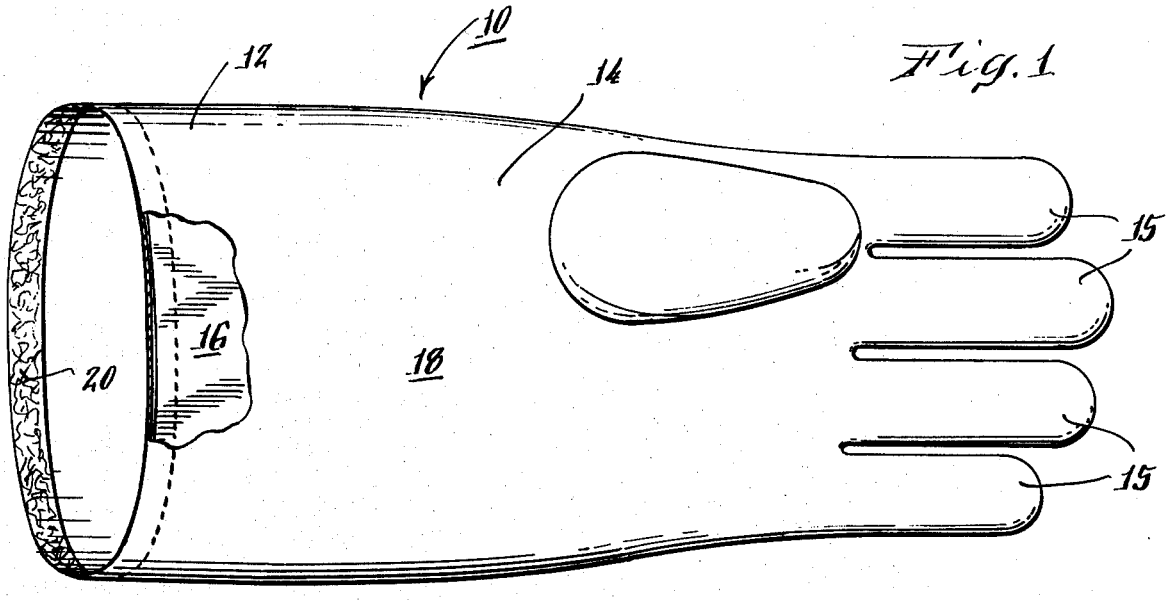
FIG. 1 illustrates a glove embodying the present invention.

Referring first to FIG. 1, there is illustrated a glove 10 embodying the present invention. It is made into the usual configuration of a glove, with a cuff portion 12, a wrist portion including fingers 15. This particular embodiment is for use in exposure to X-rays, and so is made, according to known per se principles, from an outer layer 18 of coagulated urethane, leather, vinyl, or other reasonably supple, durable, and scuff and abrasion resistant material, with an inner layer of radiation attenuation or barrier material, such as leaded vinyl, leaded rubber, or other material having such properties and adaptability to formation and use in a glove. There is included a cuff fastener 20 at the inside of the cuff 12. As illustrated, one of the two constituent elements is a so-called "velcro" strip fastener. Such fastening material is known per se, and comprises strips which have loops and barbs by which removable affixation may be effected as between juxtaposed strips. In this connection, reference is made to U.S. Pat. Nos. 3,000,384, 3,009,235, 3,076,244, and 3,130,111. The material 20 as shown in the application in FIG. 1 preferably extends entirely around the inside of the cuff edge of the glove 10.

Figure 2:
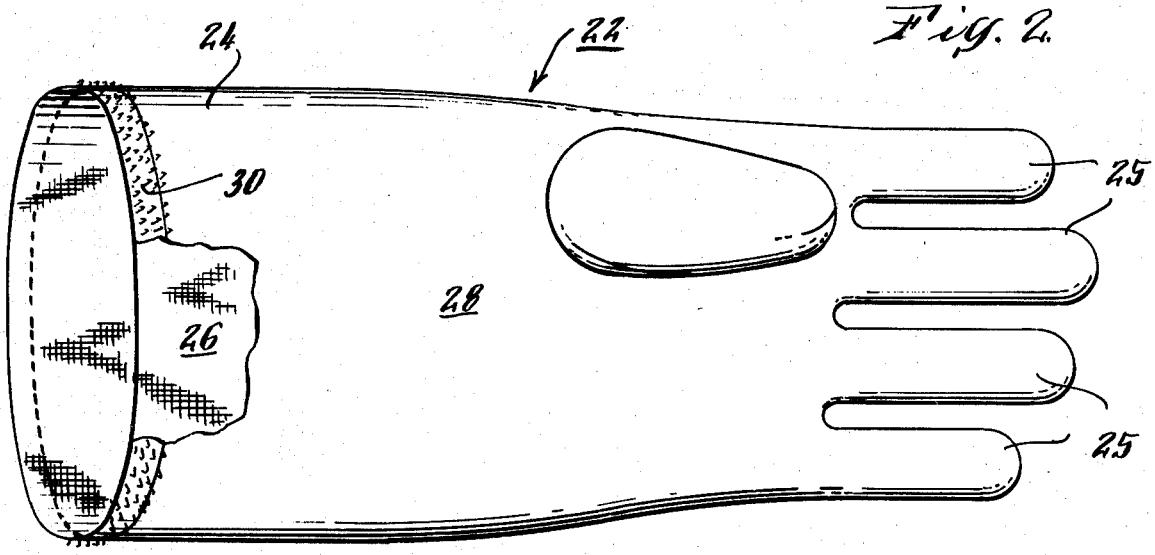
FIG. 2 illustrates a glove liner embodying the present invention.

FIG. 2 illustrates a liner 22 which may be used in conjunction with the glove shown in FIG. 1. It also has a cuff portion 24, and a hand portion including fingers 25, and is shaped and dimensioned so that its overall outside surface corresponds roughly to the inside surfaces of the glove 10. In this connection, it should be noted that although reference is made to a "glove" having five fingers, obviously a glove of fewer than five fingers, or even a "mitten", all of known per se design, also fall within the contemplation of this invention. The liner 22 has an outer surface 28 made from soft, high friction material, such as urethane foam, and an inner surface made from soft "hand" material which is supple, durable, and preferably washable and moisture absorbent. The exterior of the cuff portion 24 of the liner 22 includes a velcro strip designed to be so positioned and adapted as to be capable of being reasonably interconnected with the portions of velcro strip 20 shown in FIG. 1. Thus, if the latter extends entirely around the interior of the cuff 12, the corresponding strip 30 on the liner 22 advantageously may be made to do so also, but may also comprise a series of strip pieces arrayed along the line which a continuous strip would take. Conversely, the glove strip 20 may be intermittant and the liner strip 30 may be continuous. Another alternative is for both sets of fastener constituents (i.e., those on the interior of the gloves as well as those on the exterior of the liner) to be intermittant, but in that case more care will have to be paid to positioning the constituent pieces of the one set with those of the other, and less latitude for error and adaptability conceivably thereby usually is provided.

Figure 3:
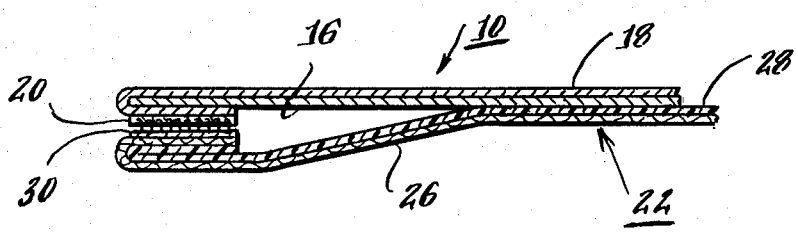
FIG. 3 illustrates a cross section of a portion of the glove shown in FIG. 1 in association with the liner shown in FIG. 2.

FIG. 3 illustrates the embodiments of this invention shown in FIGS. 1 and 2 as they may be utilized. FIG. 3 is a cross-section of the cuff portions 12, 28 of a glove and liner respectively, as removeably juxtaposed to each other. As shown, the glove laminate of outer surface 18 and radiation barrier material 16 respectively, is held by means of the fastener element 20, to the liner fastener element 30 secured to the liner laminate of urethane foam 28 and knitted polyester 26. It should be noted particularly that although in isolated areas, typically representing a small percentage of the total contact area between the inside surface of the glove and the outside surface of the liner, such as in the region next to the fasteners 20, 30 as shown in FIG. 3 or next to seams (not shown), the liner layer 28 and the glove layer 16 may be out of contact with each other. The effect of this contact, where the outer liner surface 28 is chosen for its high friction characteristics, such as the urethane foam layer 28 of liner 22, is to render the liner significantly less likely to slip, shift, or otherwise change position with respect to the interior of the glove 10. This is particularly significant in view of the substantial weight of the glove 10 by virtue of the high lead content of the barrier layer 16 and the comparative density, smoothness, and lack of surface friction which is inherent in such barrier type materials.

In addition, the fasteners 20, 30 enhance this feature and also make it possible for the user to remove the glove-liner combination without their dissociating from each other while, at the same time, permitting the liner to be removed easily, thereby making it possible for the liner to be removed, replaced, washed, dried, adjusted, or repaired, as well as permitting individual operators to not have to share liners with other persons, while being able to share the gloves themselves.

It is to be understood that the embodiments herein disclosed are by way of illustration and not of limitation, and that other embodiments may be made without departing from the spirit or scope of this invention.

I claim:

1. Apparatus for protecting the human hand from radiation comprising an outer glove made from radiation barrier material, the innermost surface of which is smooth and has a low coefficient of friction, and a removeable laminated liner for said glove, the outer lamination of which liner has a high coefficient of friction with respect to said innermost surface of said glove, and the inner lamination of which is moisture absorbent, said apparatus including means for removeably affixing the interior of said glove in the cuff region thereof to the exterior of said liner in the cuff region thereof.

2. The apparatus described in claim 1 wherein said glove includes a layer of lead-filled material by which it is rendered substantially totally impervious to X-ray radiation.

3. The apparatus described in claim 2 wherein said layer of lead-filled material comprises the innermost surface of said glove.

4. The apparatus described in any of claims 1, 2 or 3 wherein the outer surface of said liner is made from foamed plastic material.

5. The apparatus described in any of claims 1, 2 or 3 wherein said liner has a textile innermost layer.

6. The apparatus described in any of claims 1, 2 or 3 wherein the outer surface of said liner is made from foamed plastic material, and wherein said liner has a textile innermost layer.

7. X-ray proof glove apparatus comprising an outer glove having an outer wear surface and an inner surface of lead-filled material, a glove liner having a foamed synthetic outer surface and an inner textile surface and velcro fastener means located in the cuff region of said glove and said liner whereby said liner may be removeably affixedly positioned inside said glove.

8. The glove apparatus described in claim 7 wherein said fastener comprises two velcro strips, one of which extends substantially entirely around the inner surface of the cuff of said glove at its edge, and the other of which extends substantially entirely around the outer surface of the cuff of said liner at its edge.

9. The apparatus described in claim 7 in which the outer surface of said liner is urethane foam and the inner textile surface is knitted polyester.

* * * * *